United States Patent [19]

Zwettler

[11] Patent Number: 4,575,209

[45] Date of Patent: Mar. 11, 1986

[54] DISC FILM PROCESSOR

[75] Inventor: Ernest Zwettler, Santa Monica, Calif.

[73] Assignee: Houston Fearless 76, Inc, Carson, Calif.

[21] Appl. No.: 613,081

[22] Filed: May 22, 1984

[51] Int. Cl.[4] ..... G03D 3/04; G03D 3/08

[52] U.S. Cl. ..... 354/322; 354/308; 354/330

[58] Field of Search ..... 354/316, 320, 322, 329, 354/330, 308

[56] References Cited

U.S. PATENT DOCUMENTS 4,361,221 11/1982 Michal ..... 354/319

*Primary Examiner*—A. A. Mathews

*Attorney, Agent, or Firm*—Freilich, Hornbaker, Rosen & Fernandez

[57] ABSTRACT

An apparatus for automatically processing film discs including a transport system for moving the discs through successive processing stations and a friction drive system for spinning the discs at each station for agitation and/or drying. The transport system utilizes a unique carrier spindle having a nipple on one end thereof upon which a group of film discs is removably mounted. The transport system successively transports a loaded carrier spindle from one processing station to the next. At some stations the carrier spindle is positioned so that the film discs carried thereby enter a liquid tank thereat and at other stations the spindle is positioned to facilitate disc drying. The friction drive system includes a drive belt which frictionally contacts the carrier spindle at each station for spin agitation and/or drying.

19 Claims, 10 Drawing Figures

DISC FILM PROCESSOR

FIELD OF THE INVENTION

This invention relates to an improved automatic disc film processor suitable for commercial use for concurrently processing multiple film discs.

BACKGROUND

Recent developments in film, cameras, and processing equipment, primarily by the Eastman Kodak Company, have led to the wide acceptance of the disc format for film. Several U.S. patents have issued relating to automatic equipment for processing film discs; e.g., see U.S. Pat. Nos.:

4,112,452
4,112,453
4,112,454
4,167,320
4,178,091
4,188,106
4,252,430
4,361,221

In addition to processors marketed by the Eastman Kodak Company, automatic disc film processors intended for commercial use are also marketed by several other companies; e.g., Pako Corporation, Houston Photoproducts, Inc., Oscar Fisher Company, Inc., Copal, Hope Industries, Inc. and Fuji Photo Film. Although the various processors offered by these and other companies differ in their detailed mechanizations, they all include means for concurrently transporting multiple film discs through successive processing stages, which stages typically involve spin agitation through a liquid or spin drying. The specifications for a widely used commercial process are summarized in the following process table wherein it will be noticed that stages 1–6 involve passing the film discs through a liquid whereas stages 7 and 8 involve drying the film discs:

DISC FILM DEVELOPING PROCESS

| Processing Stages | Processing Time | Spin (rpm) | Temperature (°C.) |
|---|---|---|---|
| (1) Developing | 3'15" | 200 ± 20% | 37.8 ± 0.2 |
| (2) Bleaching | 6'30" | 200 ± 20% | 24–28 |
| (3) Washing 1 | 3'15" | 200 ± 20% | 24–28 |
| (4) Fixing | 6'30" | 200 ± 20% | 24–28 |
| (5) Washing 2 | 3'15" | 200 ± 20% | 24–28 |
| (6) Stabilizing | 3'15" | 200 ± 20% | 24–28 |
| (7) Slinging Water Off | 3'15" | 2,000 ± 15% | Normal temp. |
| (8) Drying | 6'30" | 200 ± 20% | Ambient + (0–10) |

Total Processing time: 35'45"

SUMMARY OF THE INVENTION

The present invention is directed to an improved apparatus for automatically processing film discs which includes a simple and reliable transport system for moving the discs through successive processing stations and a friction drive system for spinning the discs at each station for agitation and/or drying.

The transport system in accordance with the invention utilizes a unique carrier spindle upon which a group of film discs is removably mounted. The transport system successively transports a loaded carrier spindle from one processing station to the next. Each such station is associated with a particular processing stage but a single processing stage may have multiple stations associated with it. At each station associated with the aforementioned processing stages 1–6, the carrier spindle is positioned so that the film discs carried thereby enter a liquid tank thereat. The friction drive system spins the carrier spindle at each station for agitation (stages 1–6) and/or drying (stages 7, 8).

In accordance with an important aspect of the invention, the carrier spindle includes a disc mounting nipple on at least one end thereof which accommodates multiple film discs, arranged parallel to one another and perpendicular to the spindle. The discs can be loaded onto the nipple with either side out and without use of the typical disc hub keyway.

In the preferred embodiment of the invention, a housing is provided having a light tight disc loading compartment which the operator has access to via light sealing means such as loading sleeves. The compartment includes an entrance chute into which a loaded carrier spindle can be dropped for guiding the spindle to a starting position. The transport system then automatically carries the spindle from the starting position through the successive processing stations. The preferred transport system includes guide means defining a spindle path which includes spaced troughs, each trough comprising a processing station. At least one transport arm is mounted adjacent each station for rotation therethrough to pick up the spindle thereat and carry it along the path to the succeeding station. The transport arms are driven in common by a timed controller to thus, in a single cycle, transport each of a plurality of spindles from one processing station to the succeeding processing station.

In accordance with the preferred embodiment, the spindle path defines a substantially semicircular path portion between each pair of successive troughs. Each transport arm is mounted for rotation about an axis displaced from the center of the semicircular path portion to enable it to rotate through a preceding station to pick up a spindle, push the spindle along the semicircular path portion, and then rotate clear of the spindle as it is released along the path portion to the succeeding station.

In accordance with an important aspect of the preferred embodiment, the transport arms are physically spaced from the liquid tanks so that the arms only engage the spindles and never pass through the liquid in the tanks.

In accordance with a further important aspect of the invention, an inexpensive and reliable friction drive system is used to spin the carrier spindles at each processing station. The spin system includes a motor driven belt mounted adjacent the spindle path. Consequently, when a spindle is at a processing station, it is frictionally contacted by the belt, thus spinning the spindle, and the film discs carried thereby, for agitation in the liquid and/or drying.

In accordance with a further aspect of the preferred friction drive spin system, a second belt is provided which is driven at a higher speed than the first named belt. The second belt frictionally contacts a spindle only at the station associated with processing stage 7, i.e., the high speed spin stage used to sling liquid off the film discs.

DESCRIPTION OF AN EXEMPLARY EMBODIMENT

Figure 1:
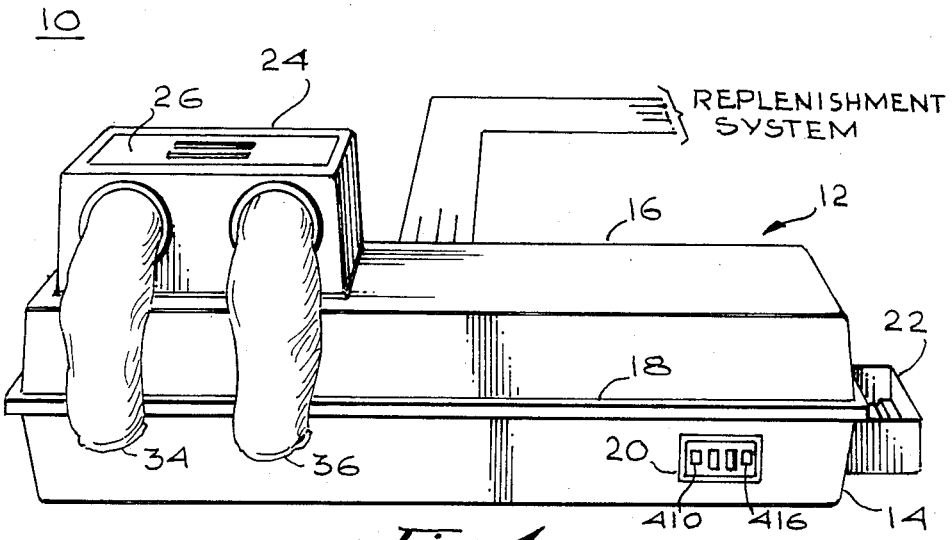
FIG. 1 is a perspective representation depicting the housing of the preferred embodiment.

Attention is initially directed to FIG. 1, which illustrates an apparatus 10 for automatically processing film discs in conformance, for example, with the process specified in the previously set forth table. The disclosed apparatus 10 is capable of processing about one hundred discs per hour making it suitable for use by commercial photoprocessing laboratories.

The apparatus 10, as depicted in FIG. 1, comprises a housing 12 having a base member 14 and a top member 16. The top member 16 is either hinged to or separate and removable from the base member 14. The members 14 and 16 have closely mating cooperating edges 18 so that when member 16 is properly seated on member 14, light is prevented from entering the interior of housing 12.

A switch control panel 20, to be described hereinafter, is mounted on the housing base member 14. Additionally, an exit box 22 extends from one end of the base member 14 for receiving a spindle carrying film discs subsequent to processing.

The top housing member 16 is shaped to define a loading box 24. The box 24 is provided with a large top opening which is closed by a removable lid 26. The box 24 and lid 26 together enclose a light tight loading compartment 28. First and second apertures 30, 32 formed in the box 24 afford access to the interior of compartment 28. The apertures 30, 32 have light sealing means such as daylight loading sleeves 34, 36 mounted thereon to permit an operator to insert his arms through the sleeves into the compartment 28 without admitting light into the compartment.

Figure 3:
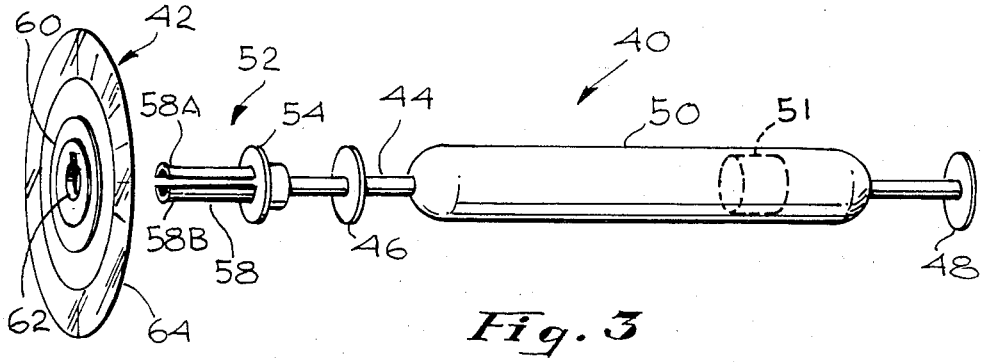
FIG. 3 is an isometric representation of a preferred carrier spindle in accordance with the present invention.

Prior to proceeding with an overall functional description of the apparatus 10, attention is directed to FIG. 3 which illustrates a carrier spindle 40 employed in accordance with the present invention for transporting film discs 42 through the multiple processing stages defined by the foregoing table, all within the apparatus 10. The carrier spindle 40 is comprised of a slender central rod 44. First and second positioning flanges 46, 48 are secured to the rod to assist in guiding the spindle 40 through the apparatus 10 as will be described hereinafter. Additionally, the carrier spindle 40 includes a ring 50 mounted around the rod 44. The ring 50 preferably includes an internal weight 51 to counter balance film discs loaded onto one end of the spindle.

More particularly, the spindle includes a disc carrier nipple 52 mounted on one end of the rod 44. The nipple 50 includes an inner flange 54 and a split shaft 58. As is well known, typical film discs 42 comprise a hub 60 having a central hole 62. A ring of film 64 is secured to and extends around the hub 60. The nipple shaft 58 is dimensioned so as to fit snugly within the hub hole 62. The split portions 58A and 58B of the nipple shaft 58 are slightly biased away from one another and must be compressed slightly to fit through the hub hole 62. The outward biasing of the shaft portions 58A, 58B frictionally engage the inner portion of the hub 60 defining the hole 62. Multiple film discs 42 can be loaded onto the nipple shaft 58 with the initial disc 42 being pushed along the shaft 58 right up to the flange 54. Subsequent film discs 42 are loaded onto the shaft 58 with the discs extending parallel to one another and perpendicular to the elongation of the rod 44. Inasmuch as the film disc hubs 60 have a slightly greater thickness than the film 64, the hubs themselves space the multiple film rings 64 from one another. It is important to recognize that the discs can be loaded onto the spindle without regard to side orientation; i.e., with either side out. It is also pointed out that the keyway typically provided in the hub 60 for orientation is not used by the nipple shaft 58.

Figure 2:
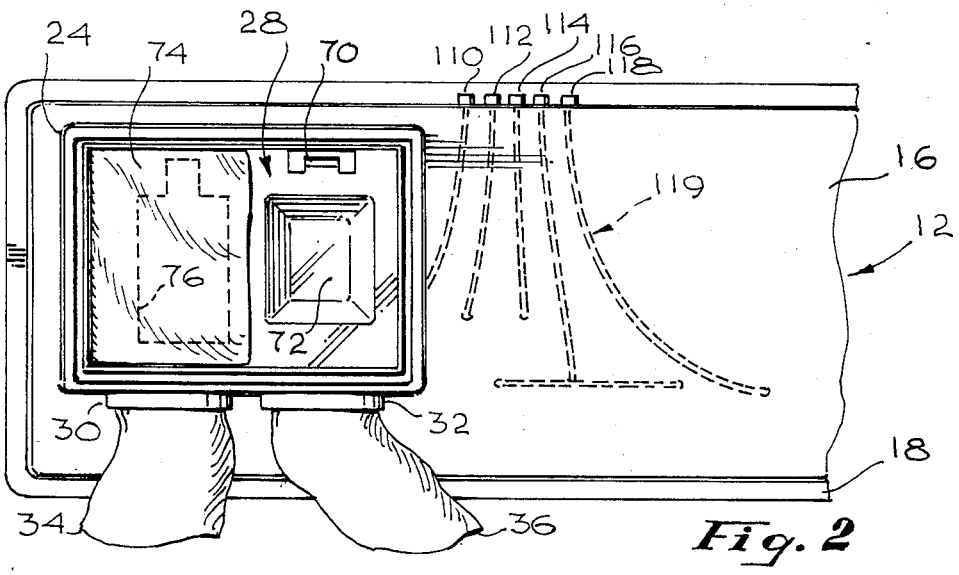
FIG. 2 is a plan view depicting a portion of the housing of FIG. 1.

As previously noted, the apparatus 10 depicted in FIGS. 1 and 2 is useful for processing film discs in a commercial photoprocessing laboratory. The film discs processed in such laboratories are received from customers with the film discs still contained in their light tight cartridges (not shown). In the use of the apparatus 10, an operator would remove the lid 26 to open the loading compartment 28. He would then typically place a single carrier spindle 40 in the compartment together with multiple film disc cartridges assumed to be five or less in the exemplary embodiment. The cartridges are of course light tight and a film disc will not be inadvertently exposed while in the cartridge. After placing the carrier spindle 40 and cartridges within the compartment 28, the operator will replace the lid 26 to thereby light seal the compartment 28. The operator will then place his hands through the daylight loading sleeves 34, 36 and into the compartment 28 through the apertures 30, 32. The operator will then pick up a disc cartridge and with the assistance of a cracking device 70, he will crack open the cartridge to free the film disc 42 therefrom. The operator of course should be careful to hold the film disc 42 by its edge or center hub. He will then place the film disc onto the disc carrier nipple 54 without regard to any particular side orientation. The debris from the cartridges can be left in a depression or trash bin 72 for subsequent removal when the compartment 28 is again opened by lifting the lid 26. After the discs are loaded onto the carrier nipple 54, the operator then lifts a light sealing flap 74 to gain access to an entrance chute 76 into which the loaded spindle carrier can be dropped. The chute 76 is keyed (FIG. 1) so it will accept the spindle carrier 40 only when it is properly oriented with the nipple end of the spindle carrier closer to the loading sleeves 34, 36.

Attention is now directed to FIGS. 4-8 which illustrate the details of the apparatus 10 contained within the housing base member 14. The member 14 includes a floor 80 and upwardly extending sidewalls 82. Mounted within the housing base member 14 is a series of aligned tanks 90 respectively containing the processing liquids identified in the aforementioned process table. Additionally, the housing base member 14 includes a carrier spindle transport system 92 for transporting a carrier spindle from the aforementioned entrance chute 76 to the various processing stations and ultimately to the exit box 22.

The series of tanks 90 includes six separate tanks, one for each of the initial six processing stages identified in the foregoing process table. More particularly, the tanks 90 includes a first tank 94 containing developing solution. A second tank 96 contains bleaching solution. A third tank 98 contains a washing liquid. A fourth tank 100 contains a fixing solution. A fifth tank 102 contains a second washing liquid. A sixth tank 104 contains a stabilizing solution.

From the foregoing process table, it will be noted that the recommended processing time for certain stages is three minutes, fifteen seconds, (i.e., stages 1, 3, 5, 6, 7) and for other stages (i.e., stages 2, 4, 8) is six minutes, thirty seconds. As will be discussed hereinafter, the transport system 92 successively transports each loaded carrier spindle 40 through multiple processing stations and is timed such that the spindle is retained for a unit interval of three minutes and fifteen seconds at each station. While at stations associated with processing stages 1–6, the film discs 42 carried by the spindle will extend into the liquids within the tanks 90. The tanks 90 are all similarly constructed, and, as will be noted in FIGS. 4 and 5, each has a length dimension approximately twice its width dimension. It should further be noted that the tanks associated with stages 1, 3, 5, 6, i.e., the developing tank 94, the first wash tank 98, the second wash tank 102, and the stabilizing tank 104 are all oriented so that their narrower width dimension extends along the elongation of the transport system 92. In contrast, the bleaching and fixing tanks 96 and 100, associated with stages 2 and 4, are oriented so that their length dimension extends along the elongation of the transport system 92. As will be seen hereinafter, the transport system 92 is configured to define substantially uniformly spaced processing stations such that one station exists for each of tanks 94, 98, 102, and 104 whereas two stations exist for each of tanks 96 and 100.

The tanks are preferably free standing and readily removable. That is, they are not plumbed in but rather rest on the floor of the housing base member 14, preferably within floor recesses (not shown) which properly orient the tanks. Inasmuch as the developing solution within tank 94 must be maintained at the elevated temperature indicated in the foregoing table, the tank is placed on a heater plate 106.

Figure 4:
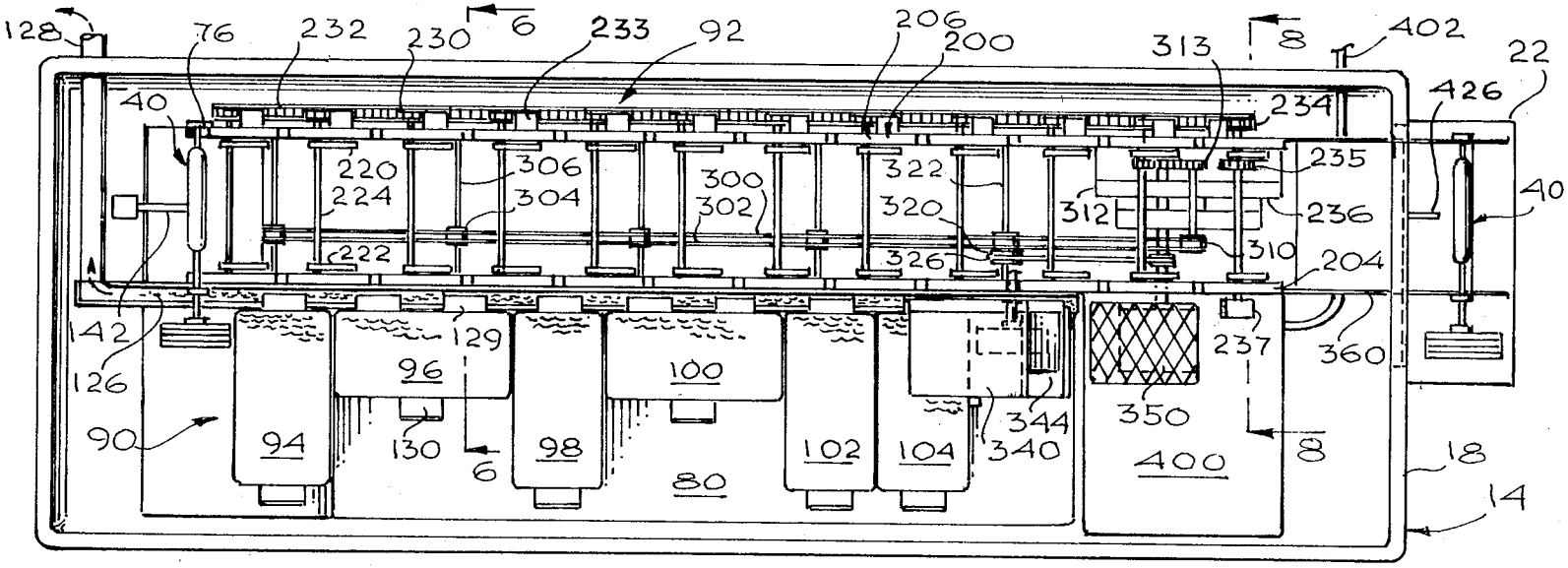
FIG. 4 is a plan view of a preferred embodiment of the invention showing the housing cover removed.

In use, the tanks can be batch loaded with appropriate liquids prior to use. Alternatively, a continuous feed replenishing system is provided which includes five inlet nipples (FIG. 2) 110, 112, 114, 116, and 118. These inlet nipples are coupled to tubes 119 (FIG. 2) which have open terminations for supplying liquid into the tanks (e.g., tube 120 into tank 96, FIG. 6). Each of the tanks is provided with an overflow discharge notch 122 (FIG. 6) in one wall thereof which permits the overflowing liquid to run off into gutter 126. The gutter 126 runs the full length of the series of tanks 90 to collect the overflow and direct it out discharge outlet 128 (FIG. 4). Each tank includes one or more hooks 129 (FIG. 6) which, when properly positioned, extends around the gutter 126 to retain the tank in position. Preferably each tank also includes a handle 130 to facilitate handling.

Prior to discussing the details of the transport system 92, it is initially pointed out that when a carrier spindle 40 is dropped into the entrance chute 76, it arrives at a starting position 140 resting on actuator 142 of a normally closed switch 143 controlling a LOAD READY light on control panel 20 (FIG. 1). From the starting position 140, the spindle is successively transported by system 92, in a manner to be described hereinafter, to a first station 144 associated with tank 94, to second and third stations 146 and 148 associated with tank 96, to a fourth station 150 associated with tank 98, to fifth and sixth stations 152 and 154 associated with tank 100, to a seventh station 156 associated with tank 102, to an eighth station 158 associated with tank 104, to a ninth station 160 associated with sling dry stage 7 and to tenth and eleventh stages 162 and 164 associated with drying stage 8.

The transport system 92 includes first and second guide plates 200 and 204 having upper guide surfaces which define a spindle path along which a carrier spindle 40 is transported from the starting position 140 (FIGS. 4, 5) to the exit box 22. The guide plates 200, 204, are vertically mounted within the housing base member 14 in spaced parallel relationship to one another. The guide plates 200, 204 extend substantially parallel to the aligned tanks 90 which are positioned to one side thereof.

Figure 5:
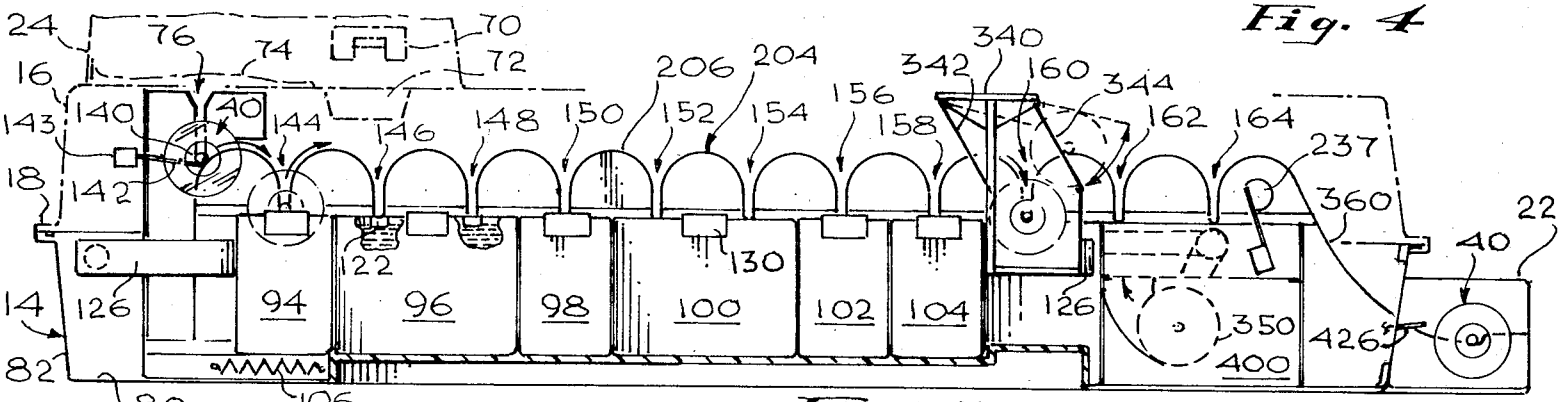
FIG. 5 is a side view, partially broken away, of the apparatus of FIG. 4.
Figure 7:
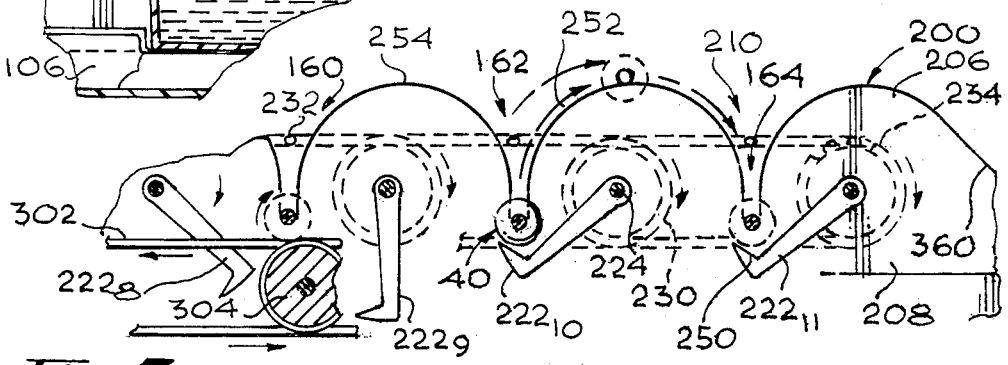
FIG. 7 is a sectional view taken substantially along the plane 7—7 of FIG. 6.
Figure 8:
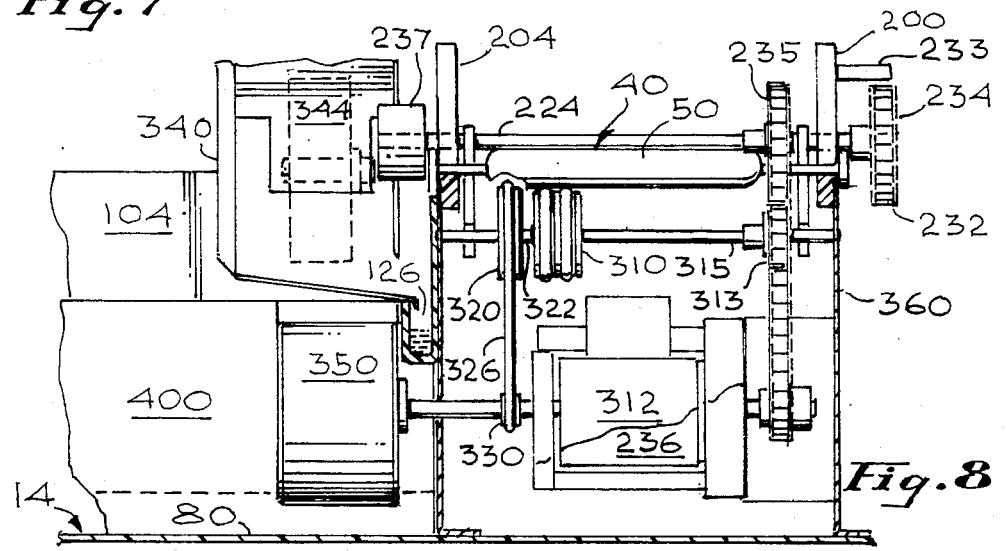
FIG. 8 is a sectional view taken substantially along the plane 8—8 of FIG. 4.

The guide plates 200, 204 are substantially identical and each comprises a series of substantially semicircular plate sections 206 (FIG. 5) extending upwardly from a common base strip 208. The plate sections 206 are uniformly spaced along base strip 208 and define troughs 210 between adjacent sections 206. The troughs are dimensioned to accommodate the carrier spindle rod 44 as depicted in FIG. 7. Each trough 210 corresponds to one of the aforementioned processing stations. Thus, as can be seen in FIG. 5, the guideplate 204 includes twelve semicircular plate sections 206 thereby defining eleven different troughs 210 between adjacent plate sections 206. By retaining a carrier spindle for a unit interval of three minutes, fifteen seconds at each of the eleven stations, the exemplary process described by the foregoing table can be executed.

The transport system 92 further includes a pair of transport arms 220, 222 mounted adjacent each processing station. Each pair of transport arms is affixed to a shaft 224 mounted for rotation between the guideplates 200, 204. That is, each shaft 224 extends through, and is journaled for rotation in, holes formed in opposed semicircular sections 206 of guideplates 200, 204. Each shaft 224 is displaced from the center or axis of the semicircles defined by the plate sections 206, slightly toward the preceding processing station, for reasons to be discussed hereinafter. The end of shaft 224, extending through guide plate 200, terminates in sprocket 230. The sprocket 230 is engaged with a timing chain 232 passing below chain guide 233 and driven by timing sprocket 234. The sprocket 234 is in turn driven by sprocket 235 chain coupled to motor 236 controlled by a timer circuit. When the motor 236 is activated, the timing sprocket 234 drives the chain 232 to rotate each of the shafts 224 through one full revolution. The transport arms 220, 224 thus also rotate one full revolution (clockwise as depicted in FIG. 7), rotating through the preceding processing station to carry a spindle therein along the semicircular path defined by the plate sections 206 to the succeeding processing station.

Figure 10:
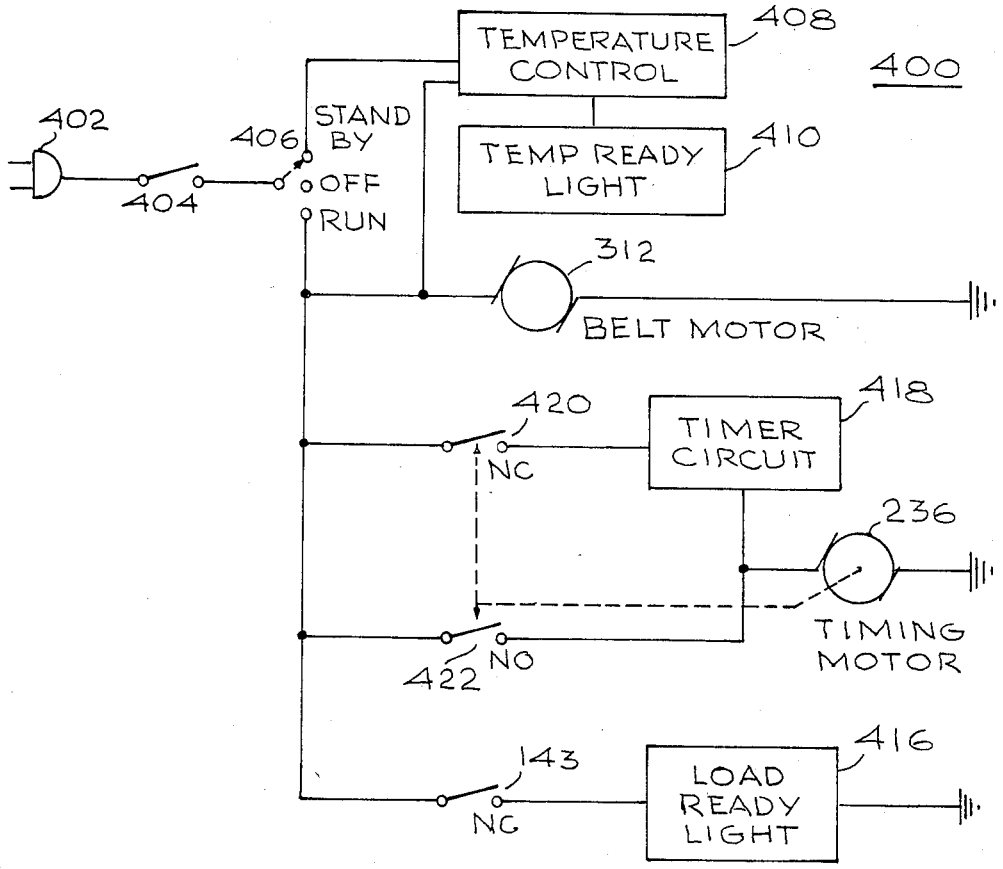
FIG. 10 is a schematic diagram of the electrical control system for the apparatus depicted in FIGS. 1-8.
Figure 9:
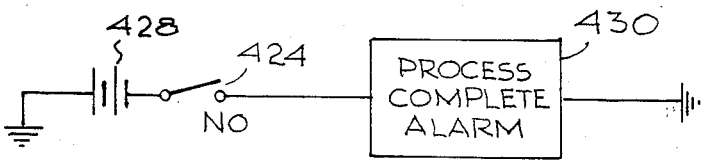
FIG. 9 is a schematic diagram depicting the drive configuration of the transport system and friction drive system.
Figure 9:
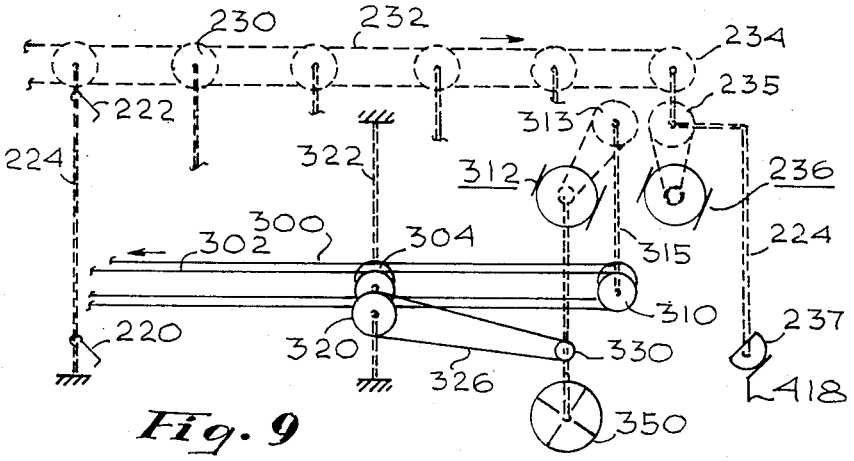

As has been mounted, motor 236 is controlled by a timer circuit which is depicted in FIG. 10 at 418. The timer circuit 418 operates in conjunction with a timing cam 237, mounted on shaft 224 associated with processing station 164, whose function will be explained in connection with FIG. 10.

Attention is now directed to FIG. 7 which schematically illustrates stations 9, 10, and 11 of transport system 92. The transport arm associated with each station is identified by a subscript in FIG. 7 which shows arms $222_8$, $222_9$, $222_{10}$, and $222_{11}$. Carrier spindles 40 are depicted in the troughs 210 of processing stations 160, 162, and 164. When the chain drive motor 236 is activated, the timing chain 232 is driven to rotate the transport arms in a clockwise direction to thus engage the spindle 40 in the immediately preceding processing station. The spindle will be cradled by the arm against terminal projection 250 and carried along the upper guide surface 252 of plate section 206 and around the peak 254 of the semicircular path portion. After passing the peak, the spindle 40 will drop into the trough of the next processing station or drop onto an exit ramp from the last station 164. Inasmuch as the shafts 224 around which the arms 222 rotate are each displaced from the center of a substantially semicircular guide surface 252 toward the preceding station, each arm 222 will be able to clear and thus move by the spindle 40 after it falls into the succeeding station.

The arms 220, 222 are all driven in synchronism by the common chain 232 and thus spindles 40 can be simultaneously accommodated in all of the processing stations. More particularly, as a consequence of the aforedescribed action of the transport arms, all of the spindles 40 are essentially concurrently removed from their stations and transported along their semicircular path portions toward their peaks 254. Thus, each station will have been vacated prior to a spindle being deposited into that station. It is to be noted in FIG. 7 that the arm $222_9$ is slightly advanced with respect to arm $222_8$ (which is mounted identically to arms $222_1$–$222_7$, not shown) and that arms $222_{10}$ and $222_{11}$ are slightly advanced with respect to arm $222_9$. This is to permit the spindle vacating the sling dry station 160 to clear the door 342 (to be discussed hereinafter) prior to the arrival of a succeeding spindle. The exemplary apparatus, as depicted in FIGS. 4 and 5, can simultaneously accommodate one spindle in each of the processing stations (a total of eleven spindles) with an additional spindle in the starting position 140.

Figure 6:
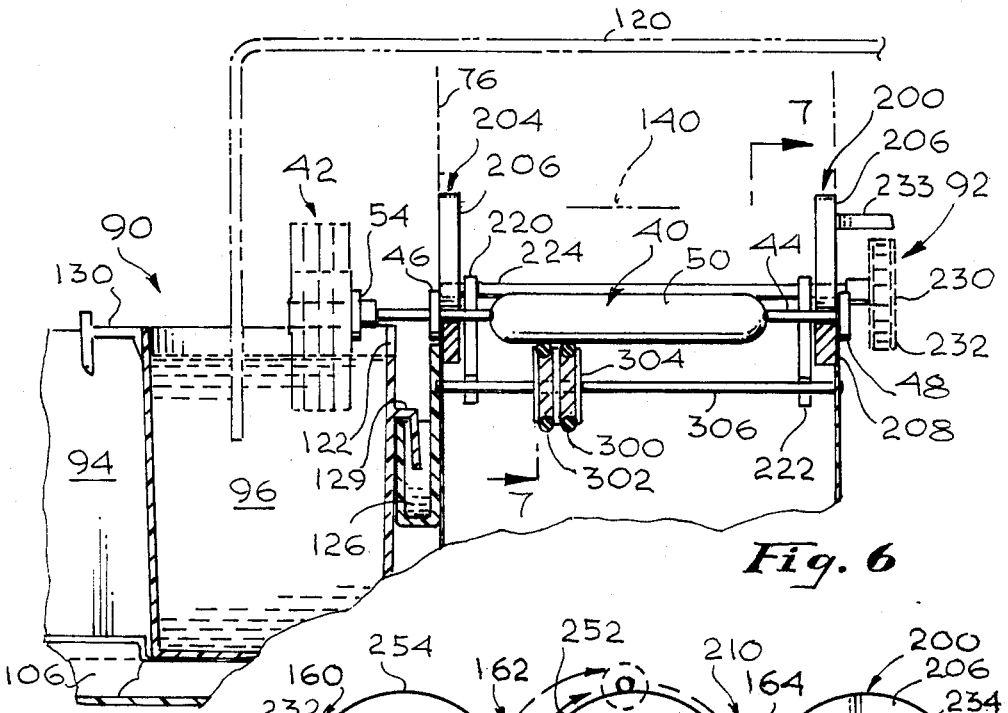
FIG. 6 is a section view taken substantially along the plane 6—6 of FIG. 4.

When a spindle 40 is received in a processing station, i.e., in a trough 210, the film discs carried thereby extend into the liquid tanks 90 (i.e., for stations 144, 146, 148, 150, 152, 154, 156, and 158). In accordance with the exemplary processing procedure summarized in the foregoing table, it is important to spin the film discs within the liquid. This spinning is accomplished in accordance with the present invention by a belt 300 (FIG. 6) which engages the spindle friction ring 50, when a spindle is accommodated in a trough 210. More particularly, a belt 300 (and a second belt 302 for redundancy) is mounted for rotation on idler wheels 304 supported for rotation on axles 306 fixedly mounted between guide plates 200 and 204. The belts 300, 302 are supported at a vertical level substantially coincident with the bottom of troughs 210 so that when a spindle 40 is accommodated within a processing station, the friction ring 50 thereof contacts the belts, as depicted in FIG. 6. The belts 300 and 302 extend around a drive pulley 310 driven by motor 312 via sprocket 313 chain coupled to motor 312. Shaft 315 couples sprocket 313 to drive pulley 310. Motor 312 is driven continuously during operation of the apparatus so that whenever a spindle is within a processing station, the friction ring 50 thereon engages the belts 300, 302 to thus spin the spindle within the guide plate troughs. As a consequence, the film discs 42 carried on the spindle nipple 54 will spin in the liquid contained in the tank, e.g., tank 96 depicted in FIG. 6.

The motor 312 and drive pulley 310 are selected to drive the belts 300, 302 at a first speed sufficient to spin the spindles in contact therewith at approximately 200 rpm, as indicated in the foregoing process table. From the table, it will be noted that the seventh processing stage, i.e., "sling water off," requires a higher speed spindle spin on the order of 2,000 rpm. For this purpose, a larger idler roller 320 is provided (FIG. 8) on axle 322 located proximate to the processor station 160 associated with processing stage 7. A high speed belt 326 extends around idler roller 320 and is coupled to the shaft of motor 312 by pulley 330. Motor 312 drives belt 326 at a substantially higher rate than belts 300, 302 as a consequence of the gearing ratio between the motor shaft and the belts via drive pulleys 310 and 330. Because idler roller 320 mounted proximate to processor station 160 has a larger diameter than the idler rollers 304 mounted proximate to the other stations, the friction ring 50 on the spindle in processor station 160, will contact belt 326 and will thereby be driven at the higher speed, i.e., 2,000 rpm, as contrasted with the lower spin speed, i.e., 200 rpm, produced by the belt 300 at each of the other stations.

In order to prevent the throwing of liquid from the film discs in the high speed spin station 160 onto discs in other stations, a canopy 340 is supported above station 160. Moreover, pair of doors 342 and 344 (FIG. 5) are gravity hinged from the canopy 340 to further prevent the throwing of liquid to other stations. The transport arms $222_9$ pick up the spindle from station 160 prior to the arms $228_8$ picking up the spindle from station 158. Thus, the spindle vacating station 160 will move out of the way enabling an arriving spindle to swing door 342 counterclockwise to permit the arriving spindle to drop into station 160. Likewise, when the spindle is transported from station 160, it will engage door 344 to hinge it counterclockwise to enable the spindle to move along the succeeding semicircular path to station 162 vacated just slightly earlier as a consequence of arms $222_{10}$ and $222_{11}$ being slightly advanced with respect to arm $222_g$.

Stations 162 and 164 are both used for the eighth processing stage, that is for drying. Drying is enhanced by the inclusion of a fan 350 (FIG. 8) preferably driven by the aforementioned belt motor 312. The fan 350 pulls air in through vent openings across warm motor 312 and exhausts it through openings 352, 354 adjacent stations 162 and 164. The transport arms subsequent to station 164 function to pick up the spindle therefrom and place it on the exit ramp 360 which leads to the exit box 22.

Attention is now directed to FIG. 10 which schematically depicts the electrical control system 400 for the apparatus 10. The control system 400 is powered from a suitable electrical power source represented by plug 402. The source 402 is serially connected through an interlock switch 404 to a three position manual switch 406. The interlock switch 404 is preferably mounted on the housing base member 14 and is closed only when the housing top member 12 is properly seated thereon for light sealing.

The switch 406 is illustrated as being a triple throw manual switch available to the operator to enable him to switch the apparatus to either an OFF mode, a STAND BY mode, or a RUN mode. When in the STAND BY mode, only the temperature control system 408 is energized. The temperature control system 408 functions to energize the heater plate 106 (FIG. 5) and control the temperature of the liquid within the tank 94. The temperature controller 408 energizes a TEMPERATURE READY light 410 on control panel 20 (FIG. 1) when the liquid reaches the desired temperature. The STAND BY mode is used whenever film discs are not being processed and it is desired to maintain the apparatus ready to accept discs for processing.

The third position of switch 406 defines the RUN mode. When operating in the RUN mode, the temperature controller 408 operates in the same manner as in the STAND BY mode. Additionally, the belt motor 312 is continually energized.

Previously mentioned switch 143 (FIG. 5) is a normally closed switch which normally illuminates the LOAD READY light 416, also on the control panel 20 (FIG. 1). However, whenever a carrier spindle 40 is dropped into the entrance chute 76 to rest on actuator 142, the switch 143 is opened to extinguish the LOAD READY light 416.

A timer circuit 418 defines a unit interval of three minutes and fifteen seconds. The timer circuit is energized through a normally closed switch 420. At the end of the unit interval, the timer circuit 418 supplies a drive pulse to timing motor 236. The timing motor 236 drives a timing cam 237 (FIG. 5) which in turn controls the aforementioned normally closed switch 420 and in addition a normally opened switch 422. That is, after the timer 418 supplies a drive pulse to the timing motor 236, the motor 236 starts to rotate cam 237. Very early in the cam cycle, the switch 420 is momentarily opened to thereby reset the timer 418. The normally open switch 422 remains closed for an interval determined by the cam 237 which is equal to the time necessary to rotate the transport arms through one full revolution.

A normally open switch 424 is controlled by actuator 426 (FIG. 5) to sense the passage of a spindle from the last processing station 164 along the exit ramp 360. The switch 424 is connected between a power source, preferably a battery 428, and a PROCESS COMPLETE alarm 430, which when activated preferably produces an audible sound.

From the foregoing, it should now be appreciated that an improved disc film processor has been disclosed herein capable of concurrently processing multiple film discs. As a consequence of its unique construction exemplified by the highly efficient transport system and friction driven spin system, the apparatus is relatively inexpensive to manufacture and highly reliable in operation.

I claim:

1. Apparatus for processing film discs comprising:

at least one elongated carrier spindle;

mounting means on at least one end of said spindle for removably mounting a plurality of film discs thereon;

a plurality of substantially aligned tanks, each for containing a liquid;

transport means for moving said spindle along a defined path including a plurality of processing stations, each station located proximate to one of said tanks, whereby when said spindle is at a processing station, the film discs thereon extend into the liquid in the tank located proximate thereto;

spin means frictionally engaging said spindle at each of said processing stations for rotating said spindle to spin said film discs in said liquid;

said transport means including a plurality of transport arms each mounted for unidirectional rotation through a full 360° cycle about an axis located adjacent to a different one of said stations; and means for rotating said transport arms to concurrently transfer spindles from each of said stations to a succeeding station.

2. The apparatus of claim 1 including spindle guide means having a guide surface forming said path and wherein said guide surface defines a plurality of spaced troughs, each for receiving said spindle and each comprising one of said processing stations.

3. The apparatus of claim 2 wherein said guide means defines a substantially semicircular path portion between each pair of successive troughs; and wherein each of said transport arms during a single rotation cycle carries a spindle from one trough and along a semicircular path portion toward the succeeding trough.

4. The apparatus of claim 3 wherein each of said transport arms is mounted for rotation about an axis displaced from the center of a semicircular path portion for allowing each of said arms to rotate through a preceding trough to pick up a spindle and move it along a semicircular path portion and then clear the succeeding trough.

5. The apparatus of claim 1 wherein said transport arms are mounted spaced from said tanks whereby said arms remain out of contact with liquid therein.

6. The apparatus of claim 2 wherein said spin means includes an elongated belt; and means mounting said belt for movement along a path adjacent said troughs to frictionally engage spindles received in said troughs.

7. Apparatus for processing film discs comprising:

at least one elongated carrier spindle;

mounting means on at least one end of said spindle for removably mounting a plurality of film discs thereon;

a plurality of substantially aligned tanks, each for containing a liquid;

transport means for moving said spindle along a defined path including a plurality of processing stations, each station located proximate to one of said tanks, whereby when said spindle is at a processing station, the film discs thereon extend into the liquid in the tank located proximate thereto;

said transport means including a plurality of transport arms each mounted adjacent a different one of said stations;

means for actuating said transport arms to concurrently transfer spindles from each of said stations to a succeeding station;

spindle guide means having a guide surface forming said path, said guide surface defining a plurality of spaced troughs, each for receiving said spindle and each comprising one of said processing station;

said spindle guide means including first and second substantially identical guide plates mounted in spaced parallel relationship, each having a guide surface forming said path;

said spindle extending between said guide plates supported on said first and second guide plate guide surfaces; and spin means frictionally engaging said spindle at each of said processing stations for rotating said spindle to spin said film discs in the liquid in the tank located proximate thereto;

said spin means including an elongated belt mounted for movement along a path adjacent said troughs to frictionally engage spindles received in said troughs.

8. The apparatus of claim 7 including positioning means mounted on said spindle for retaining said spindle on said first and second guide plate surfaces for movement therealong; and a ring mounted on said spindle between said positioning means for engaging said belt.

9. The apparatus of claim 7 wherein said transport arms are located between said guide plates and said tanks are located to one side of said guide plates.

10. The apparatus of claim 1 wherein said spin means includes:

a first belt mounted adjacent said path in frictional contact with a spindle at each of a first group of said plurality of processing stations;

motor means; and first means coupling said motor means to said first belt for driving said first belt to rotate spindles in frictional contact therewith at a first speed.

11. The apparatus of claim 10 including fan means located adjacent one of said processing stations for producing an air flow past film discs carried by a spindle thereat.

12. Apparatus for processing film discs comprising:

at least one elongated carrier spindle;

mounting means on at least one end of said spindle for removably mounted a plurality of film discs thereon;

a plurality of substantially aligned tanks, each for containing a liquid;

transport means for moving said spindle along a defined path including a plurality of processing stations, each station located proximate to one of said tanks, whereby when said spindle is at a processing station, the film discs thereon extend into the liquid in the tank located proximate thereto;

spin means frictionally engaging said spindle at each of said processing stations for rotating said spindle to spin said film discs in said liquid;

said spin means including a first belt mounted adjacent said path in frictional contact with a spindle at each of a first group of said plurality of processing stations;

motor means; and first means coupling said motor means to said first belt for driving said first belt to rotate spindles in frictional contact therewith at a first speed;

said spin means further including a second belt mounted adjacent said path in frictional contact with a spindle at at least one processing station not in said first group; and second means coupling said motor means to said second belt for driving said second belt to rotate spindles in frictional contact therewith at a second speed different from said first speed.

13. The apparatus of claim 12 including a first door positioned adjacent said at least one processing station for preventing the slinging of liquid therefrom to a preceding station; and means hingedly mounting said first door for permitting a spindle to move therepast from said preceding station into said at least one processing station.

14. An apparatus for transporting film discs in succession through a plurality of processing stations comprising:

at least one elongated carrier spindle having first and second ends;

spindle guide means having first and second spaced guide surfaces defining a path including a succession of spaced troughs and a substantially semicircular path between each pair of successive troughs;

said carrier spindle supported on said first and second spaced guide surfaces for movement along said path with said first spindle end extending beyond said first guide surface;

means on said spindle first end for mounting a plurality of film discs thereon;

actuatable transport means mounted adjacent each of said troughs each for transporting a spindle from a preceding trough and along the succeeding semicircular path to the succeeding trough; and spin means positioned to frictionally engage a spindle in each of said troughs for rotating said spindle to spin film discs mounted thereon.

15. The apparatus of claim 14 wherein said actuatable transport means includes a plurality of transport arms each mounted proximate to a different one of said troughs for rotation with respect thereto.

16. The apparatus of claim 15 wherein each of said transport arms is fixedly mounted on a different rotatably mounted shaft;

a common shaft drive means coupled to each of said shafts; and timer means coupled to said common shaft drive means for periodically rotating said shafts through one full rotation for substantially concurrently transporting a spindle from each trough to the succeeding trough.

17. The apparatus of claim 16 wherein at least one of said transport arms is advanced on its shaft relative to the other arms whereby it will remove a spindle from the trough proximate thereto prior to said other arms.

18. The apparatus of claim 14 including a plurality of liquid tanks; and means supporting each of said tanks adjacent a different one of said troughs for causing the film discs carried by a spindle received in one of said troughs to extend into the tank adjacent thereto.

19. The apparatus of claim 14 including a plurality of liquid tanks supported adjacent to said first guide surface and outside of the spacing between said first and second guide surfaces, each tank located proximate to a different one of said troughs; and wherein said transport means includes a plurality of transport arms each mounted for rotation in a plane located between said first and second guide surfaces whereby said transport arms cannot contact liquid in said tanks.

* * * * *